United States Patent [19]

Welschlau

[11] Patent Number: 4,587,898

[45] Date of Patent: May 13, 1986

[54] CORRUGATED PAPER INSTALLATION FOR MANUFACTURING OF PRINTED CORRUGATING PAPER CUTS WITH A CORRUGATED PAPER MACHINE AND A ROTARY PRINTING MACHINE INTEGRATED THEREIN

[75] Inventor: Udo Welschlau, Northeius, Fed. Rep. of Germany

[73] Assignee: VEPA Zellstoff - und Papierholding AG, Glarus, Switzerland

[21] Appl. No.: 141,105

[22] Filed: Apr. 17, 1980

Related U.S. Application Data

[63] Continuation-in-part of Ser. No. 931,186, Aug. 4, 1978.

[30] Foreign Application Priority Data

Dec. 10, 1977 [DE] Fed. Rep. of Germany ..... 2745854

[51] Int. Cl.[4] ..... B41F 13/56

[52] U.S. Cl. ..... 101/224; 101/226; 101/247

[58] Field of Search ..... 101/212, 216, 219, 247, 101/178, 226, 181, 224

[56] References Cited

U.S. PATENT DOCUMENTS

| | | | |
|---|---|---|---|
| 2,128,343 | 8/1938 | Bemis | 101/178 |
| 2,836,018 | 5/1958 | Key | 83/303 |
| 3,139,025 | 6/1964 | Chambon | 101/247 |
| 3,296,908 | 1/1967 | Shields | 83/303 |
| 3,408,886 | 11/1968 | David | 83/479 |
| 3,489,043 | 1/1970 | Dent | 83/479 |
| 3,835,775 | 9/1974 | Benton | 101/178 |
| 4,108,067 | 8/1978 | Werner | 101/247 |

*Primary Examiner*—A. J. Heinz
*Attorney, Agent, or Firm*—Max Fogiel

[57] ABSTRACT

A corrugated paper arrangement for manufacturing printed corrugated paper cuts, in which a corrugated paper machine has an integrated rotary printing machine with several printing stations, and at least one longitudinal cutter and at least one transverse cutter. The printing stations are integrated to serve for printing a paper web with laterally adjacent areas of different width and length, which are individually or in groups connectable with the drive of the arrangement. The printing stations carry for each area, printing forms mounted on an endless exchangeable carrier band of different lengths. Several longitudinal cutters and transverse cutters or punching presses are provided for the different area lengths.

3 Claims, 6 Drawing Figures

CORRUGATED PAPER INSTALLATION FOR MANUFACTURING OF PRINTED CORRUGATING PAPER CUTS WITH A CORRUGATED PAPER MACHINE AND A ROTARY PRINTING MACHINE INTEGRATED THEREIN

The present application is a continuation-in-part of the parent application Ser. No. 931,186, filed Aug. 4, 1978.

BACKGROUND OF THE INVENTION

The invention relates to a corrugated paper installation for making printed corrugated paper cuts with a corrugated paper machine and a therein integrated rotary printing machine having several printing stages as well as with at least one longitudinal cutter and at least one transverse cutter or a punching press.

Such installations are known for relatively small band widths. For example, a roller printing machine may be integrated in a corrugated paper installation. The form cylinders extend over the width of the paper web to be printed, so that the paper web is printed first in the installation via the integrated printing stages, and then combined with a corrugated paper web to form the corrugated paper. In this manner, printed patterns up to approximately 800 mm widths can be applied to a corrugated paper web. It is also possible to arrange several identical printed pictures with identical pattern repeat adjacent one another, if the individual printed picture has a correspondingly lower width.

If a switch is now to be made from one printed picture to another printed picture, then the entire installation must be shut down in order to exchange the form cylinders. After the installation of the new form cylinders in the rotary printing machine the production on the corrugated paper installation can be started up again. In this installation it is a disadvantage that a change of the printed picture can be effected only by interrupting the production of the corrugated paper installation that this additionally requires a relatively long time.

If several identical pattern repeats are printed next to each other, then a longitudinal cutter is provided at the end of the installation which severs the printed corrugated paper web lengthwise. The individual repeats are then severed by transverse cutters or rotary punches.

It is also known to use a preprinted web in a roller carrier of a corrugated paper installation and to combine this web with the other layers of the corrugated paper in a laminating station. This known technique makes it possible to increase the width of the corrugated paper web up to about 1600 mm. However, here also the conversion is time consuming and expensive between the individual runs. Here, also, the production of the corrugated paper installation must be interrupted if a new web with other printed pictures is to be laminated. In addition, the transverse cutters must be newly adjusted.

A rotary is known from German Patent No. 426,349 with which it is possible, for example, to print a paper web by means of several printing stages with respectively different pattern repeats in sequence, in order to obtain a pattern repeat length which differs from the repeat length which is determined by the circumference of the form cylinders. Here, one printing stage after the other is utilized. From this patent it is also known that the individual printing stages print upon a rubber cloth which passes between a printing and counterpressure roller and acts as an intermediate carrier for the individual printed pictures before it transmits these to the material being printed.

From German Allowed Application 1,786,507 and from the "Boersenblatt fuer den deutschen Buchhandel" of June 2, 1977, page 16, it is known to utilize an endless band-shaped printing plate carrier which has several different or identical pattern areas which are printed one after the other. In this manner, whole books can be printed sequentially with their different pages. The problems of a corrugated paper installation, however, are not addressed in these pure printing machines.

SUMMARY OF THE INVENTION

The purpose of the invention is to provide a corrugated paper installation for the manufacture of printed corrugated paper which permits the continuous production of corrugated paper cuts which are printed at least on one side, whereby several patterns arranged adjacent one another can be obtained with if desired different pattern repeat, and in which the individual printed pictures and pattern repeats can be changed rapidly and without having to interrupt the production of the corrugated paper machine.

According to the invention this is achieved in that printing stations are integrated which are suitable for printing a paper web with laterally adjacent pattern areas of different width and length, which are connectable with the drive of the installation individually or in groups, and which for each pattern repeat carry printing forms on an endless exchangeable carrier band of different lengths, and that several longitudinal cutters and transverse cutters or punching presses are provided for the different pattern repeat lengths.

Thus, the invention proposes to arrange a plurality of specially constructed printing stations integrated within a corrugated paper installation, of which always only a part is in use, so that the printing stations which at any moment are not printing can be changed over. The individual printing stations which are known per se, are connectable with the drive of the installation individually or in groups, so that they can be used selectively for printing purposes. The arrangement of the printing forms on endless exchangeable carrier bands of different lengths assures a rapid change-over within the corrugated paper installation without having to interrupt the production of the corrugated paper machine. All counterpressure cylinders associated with the individual printing stations can be constructed to extend over the whole width of the paper web. This assures a guidance of the paper web in the area of the printing stations even if the printing stations are not printing at any moment.

The invention can be advantageously further developed by using an embodiment in which each carrier band extends over the width of the paper web and the printing cylinder and the support and tension rollers are also constructed to extend over the width of the paper web.

It is, however, also possible to construct the installation in such a manner that each printing band with the support and tension rollers extends only over a part of the width of the paper web and that the respective carrier band with the printing cylinders and the support and tension rollers is made movable transverse to the direction of advancement of the paper web and is adjustable in accordance with the position of the pattern area.

Both embodiments make it possible to print a paper web, which is then later used to produce the corrugated paper web, up to a width of approximately 2.5 meters simultaneously with different patterns insofar as length and width is concerned. For changing the printed picture it is no longer necessary to interrupt production. It is only necessary to switch off the corresponding printing stations and to switch on the other printing stations. The carrier bands consist of a bendable web in form of an endless band on which the printing forms are secured. One or several patterns of identical pattern lengths may be provided on a carrier band. In the case of differential pattern length the carrier bands themselves are of course also of different lengths.

The carrier bands may themselves be constructed as printing forms, and the carrier bands may either extend over the full width of the paper web or else the carrier bands may extend over only a part of the width of the paper web, as it is described with reference to the second embodiment. In both cases the actual surface area portions which participate in the printing, extend only over a part of the width of the paper web, unless in a specific special case several identical patterns are arranged adjacent one another.

The carrier bands assure that a printing station can be changed over in the briefest possible time, because only the carrier band must be exchanged. The tension rollers at the printing station must then be readjusted for the possibly different loop-length of the carrier band. This is also possible in the shortest amount of time. The printing stations are provided approximately corresponding to double, triple or a multiple the number of patterns. Advantageous appears the arrangement of approximately twenty printing stations for a width of the paper web of approximately 2.5 m. At this width and with the stated number of printing stations it is possible to work with three or even four pattern areas of different printed pictures adjacent one another. It is understood that only one part of the printing stations is used for the production run being printed at any moment, with each printing station printing only a one color and in the event of multi-color printing several colors being applied per pattern area by different printing stations in sequence. The other printing stations can be changed over in this time period and are then available for printing the next successive run or order. If a printing order is completed, then it is only necessary to switch off the corresponding printing stations; the new printing stations are switched on. This is effected without interrupting the manufacture of the corrugated paper.

In doing so, the following difficulty occurs.

In the integration of the special printing stations with the carrier bands carrying the printing forms a peculiarity occurs, in contradistinction to normal rotary printing machines which work with printing cylinders of different diameters. The carrier bands which carry the printing forms do not rest on the circumference of the printing cylinders, but are guided in form of a loop and supported on supporting and tension rollers. The actual printing cylinder carries no printing forms but serves only to press and guide the carrier band.

In these special printing stations which are integrated according to the invention there is no association between the angular speed of the printing cylinder and the angular speed of the carrier band. While the carrier band has the same circumferential speed on the printing cylinder as the printing cylinder itself, it is not possible to arrive here at a relationship between the angular speed of the carrier band and the angular speed of the printing cylinder.

This is in contrast to a normal rotary printing machine in which the printing forms are on the circumference of the printing cylinder. There, it is always possible to determine that after a complete revolution of the printing cylinder the printing form begins again with certainty, respectively that the identical portion is used for printing. Because this specific association is missing in the printing stations integrated according to the present invention, a relative rapport between the individual printing stations must be achieved in a different manner. This relative rapport is, of course, necessary only for those printing stations which must print one over the other with pattern rapport in a printing order.

This will be explained by way of an example in more detail. While the corrugated paper machine operates and for example a certain number of printing stations is in printing operation, it is assumed that the printing stations No. 1, No. 5 and No. 7 in a row of 10 printing stations are standing still, so that they can be switched over for the next following printing order requiring a three-color print.

Thus, three carrier bands with the printing forms are placed about the printing cylinders and tension rollers of the printing stations 1, 5 and 7.

The spacing between the first printing station and the fifth printing station as well as the spacing between the fifth and seventh printing station are known and do not change, since the printing stations are fixedly arranged relative to one another.

It is now necessary to adjust the three printing stations for pattern rapport in idle mode, i.e. such that the printed pictures can be printed upon the advancing paper web in proper relationship to one another and over one another, when the counterpressure cylinders press the paper web against the carrier bands. As is known, no printing occurs but the pattern-rapport adjustment is necessary. This is accomplished as follows:

First, the three printing stations No. 1, 5 and 7 are started up and brought up to speed, whereby a friction coupling between the drive of the printing stations and the continuous main drive of the corrugated paper machine is engaged. When this production speed is reached, the transmission of each printing station is fixedly coupled via a mechanically interengaging coupling, for example a tooth coupling, with the main drive, i.e. with the through going main shaft of the corrugated paper machine.

Now the printing cylinders of the individual printing stations are turning at working speed, but thus far no relative rapport has been achieved between the carrier bands of the printing stations 1, 5 and 7.

If the printing stations were to be switched on in this condition, i.e. if they were to print, then a substantial amount of scrap corrugated paper would be printed, which would not be properly printed because the printed pictures would be shifted with reference to one another.

In order to accommodate for this error of the mutual shifting (relative pattern rapport) it is now necessary to observe marks provided at the carrier bands at defined locations and to shift the carrier bands additionally relative to one another in such a manner that the relative pattern rapport is obtained. One of the three printing stations to be adjusted can be taken as the main printing station, the carrier band of which need not be shifted relatively. This may, for example, be the printing station No. 1.

The carrier bands of the printing stations No. 5 and No. 7 must now be adjusted. With the aid of an observation device and a computer the phase position of the marks of the carrier bands for the printing stations No. 5 and 7 is observed on an indicating instrument, for example on a screen. Depending upon the deviation from the mark of the carrier band of printing station No. 1 a setting device and a planetary gear stage provided in the transmission of each printing station are used to effect a shifting of the carrier band during idling, until the three marks of the three carrier bands are in rapport, i.e. until relative pattern rapport has been reached. It is known that a planetary gear stage has two inputs and an output, so that it operates as a differential device permitting via the setting device and the planetary gear stage each carrier band to be positionable relative to another carrier band.

Only when the relative pattern rapport of the three printing stages No. 1, No. 5 and No. 7 has been reached and the preceding printing run is completed, interrupting the operation of the corrugated paper machine a switchover is effected at the printing stages, i.e. the printing stages of the just completed run are switched off whereas the preprinting stages No. 1, No. 5 and No. 7 are pressed for operation of the counterpressure cylinders against the paper web, so that without or with only a small amount of scrap the production of corrugated paper can be carried on continuously.

In place of the heretofore described single setting device each printing station may have two setting devices for a coarse and a fine setting of the relative pattern rapport, whereby a coupling is provided between the setting device for the fine adjustment and the second input of the planetary gear stage.

BRIEF DESCRIPTION OF THE DRAWINGS

The invention can be variously embodied. It is described in the drawing with the aid of several exemplary installations and will hereafter be described further.

DESCRIPTION OF THE PREFERRED EMBODIMENTS

Figure 1:
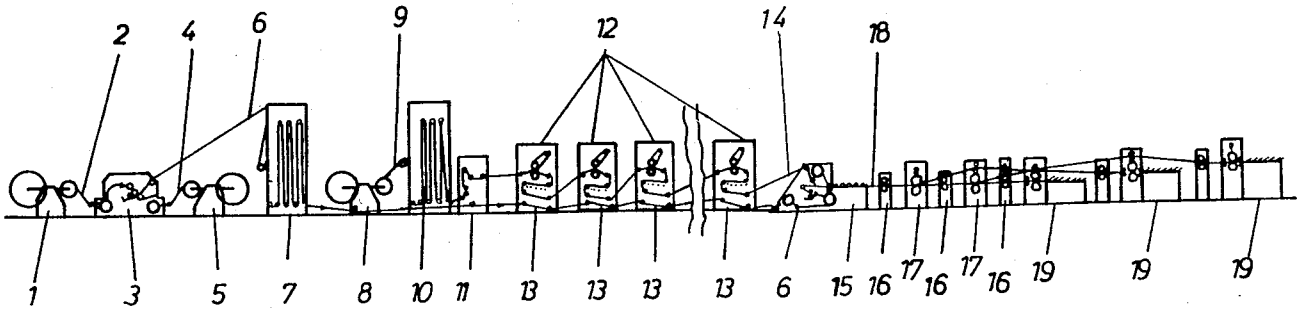
FIG. 1 shows a schematic side view of an installation.

The installation illustrated in FIG. 1 serves to produce corrugated paper which is printed on one side. A paper web 2 is pulled off a roller carrier 1 and is formed in a corrugated paper machine 3 to corrugated shape and here united with a paper web 4 coming from a roller carrier 5. The web 6 thus produced advances into a storage 7 and is pulled from there through the next-following parts of the installation without here undergoing any further treatment. The storage 7 can also be omitted.

A paper web 9 travels from a roller carrier 8 into a storage 10 and from there via a pulled-off drive 11 into a printing machine 12 which has a plurality of individual printing stations 13, for example, twenty of them. The paper web 9 is here printed on its upper side by several of the printing stations 13.

The printed paper web 14 travels at the end of the printing machine 12 into a laminating station 15 where it is united with the web 6 to form a corrugated paper web 18.

At the end of the installation there are provided pull-off devices 16 and longitudinal cutters 17; the longitudinal cutters 17 cut the corrugated paper web 18 lengthwise according to the printed-on laterally adjacent numbers of pattern repeats. Transverse cutters 19 or rotary punches are also provided in order to cut the web transversely and to separate the individual cuts from the partial webs.

Figure 2:
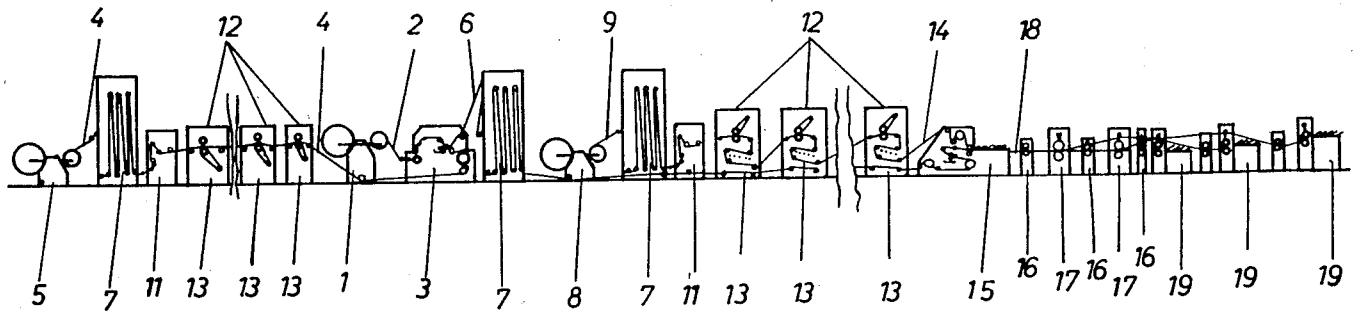
FIG. 2 shows a schematic side view of another installation.

The installation according to FIG. 2 is basically similar, but here both sides of the corrugated paper web 18 are printed. The paper web 4 is pulled off the roller carrier 5 and supplied via the storage 7 and the drive 11 to the first part of the printing machine 12. Here, three printing stages 13 are illustrated. It is understood that the number thereof can be varied here also. These three printing stations 13 serve to differently color or print the paper web 4 in accordance with the pattern distribution. The paper web 4 is then supplied to the corrugated paper machine 3. The paper web 2 which forms the corrugation is pulled off the roller carrier 1. In the corrugated paper machine 3 the webs 2 and 4 are united with one another. The web 6 is obtained which is advanced through the storage 7 and the following aggregates up to the laminating station 15.

The paper web 9 is pulled off the roller carrier 8 and supplied via the storage 7 and a further pull-off drive 11 into the second part of the printing machine 12, where again a number of printing stations 13 is provided. Since here the outer side of the later cut is to be printed, a comparably larger number of printing stations is provided, analogous to the installation in FIG. 1. The printed paper web 14 is united with the web 6 in the laminating station 15 and the corrugated paper web 18 is obtained which, just as in the embodiment of FIG. 1, is subdivided by longitudinal cutters 17 and transverse cutters 19.

Figure 3:
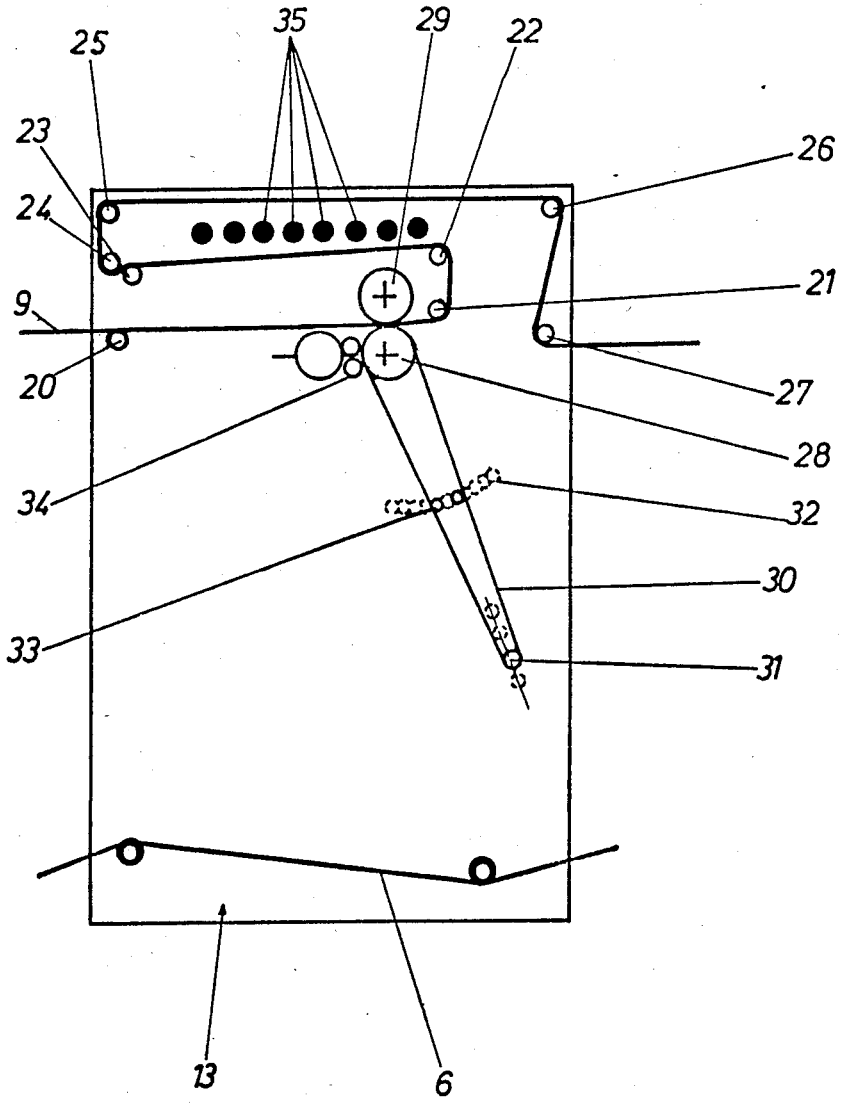
FIG. 3 shows a schematic side view of an individual printing station.

FIG. 3 shows an individual printing station 13 of the printing machine 12 in schematic view. The paper web 9 to be printed is passed between the guide rollers 20, 21, 22, 23, 24, 25, 26 and 27 through the printing station 13. The printing cylinder 28 is stationarily journaled. Oppositely it there is provided a counterpressure cylinder 29 which can be pushed against or pushed away from the printing cylinder 28. The printing cylinder 28 is embraced by the carrier band 30 which according to the length of the pattern and possibly the number of patterns can have a different length and carries the printing forms. Different support and tension rollers 31, 32, 33 are provided which are shiftably mounted in order to permit an accommodation to the respective lengths of the carrier band 30. The carrier band 30 is wider than the corrugated paper web and has in the projecting marginal areas perforations which serve for its drive. The drive means necessary for this are individually connectable with the machine drive for the entire installation. It is also possible to connect groups of printing stations 13 for joint operation. The printing forms on the carrier band 30 are inked via an inking station 34. A drying installation 35 is provided between the guide rollers 22 and 23.

Figure 5:
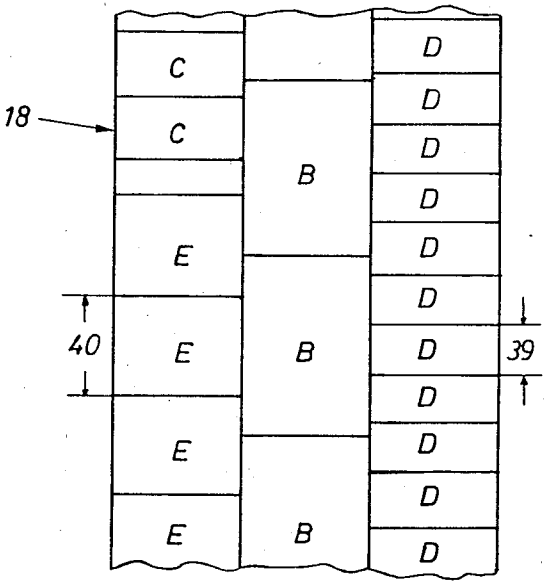
FIG. 5 is a top view of the corrugated paper web of FIG. 4 after the exchange of some printing stations.
Figure 4:
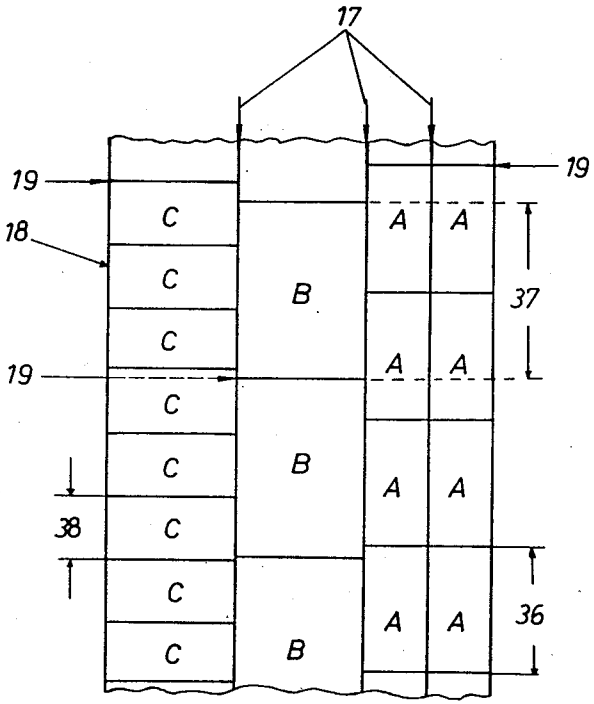
FIG. 4 is a top view of the corrugated paper web subdivided into printed areas.

The operation which is possible with the installation shown in FIGS. 1 and 2 can best be understood with reference to the corrugated paper web 18 shown in FIGS. 4 and 5. FIG. 4 shows the moment at which the corrugated paper web 18 leaves the laminating station 15, i.e. at which the printing is completed.

According to FIG. 4, four patterns are printed over the width of the corrugated paper web 18, namely the double pattern with the printed picture A and the pattern length 36, at the center a different pattern with the printed picture B and the pattern length 37 and at the other edge a third pattern with the printed picture C and the pattern length 38.

It is understood that this corrugated paper web 18 is then severed by the longitudinal cutters 17 which are indicated only by arrows. The transverse severing is effected by the transverse cutters 19, respectively, rotary punches.

FIG. 5 shows again the corrugated paper web 18, but after the print application with the printed picture A has been completed. In its place a print application with the printed picture D was carried out. The print application B was retained because here for example the required number has not yet been reached. In addition, the switch-over from the printing run with the printed picture C to the printed picture E is just being illustrated. The pattern with the printed picture D has the pattern length 39 and the print with the printed picture E has the pattern length 40. As a rule, such a change of production results only in a very small amount of scrap (see change-over of the printed pattern C to E).

Figure 6:
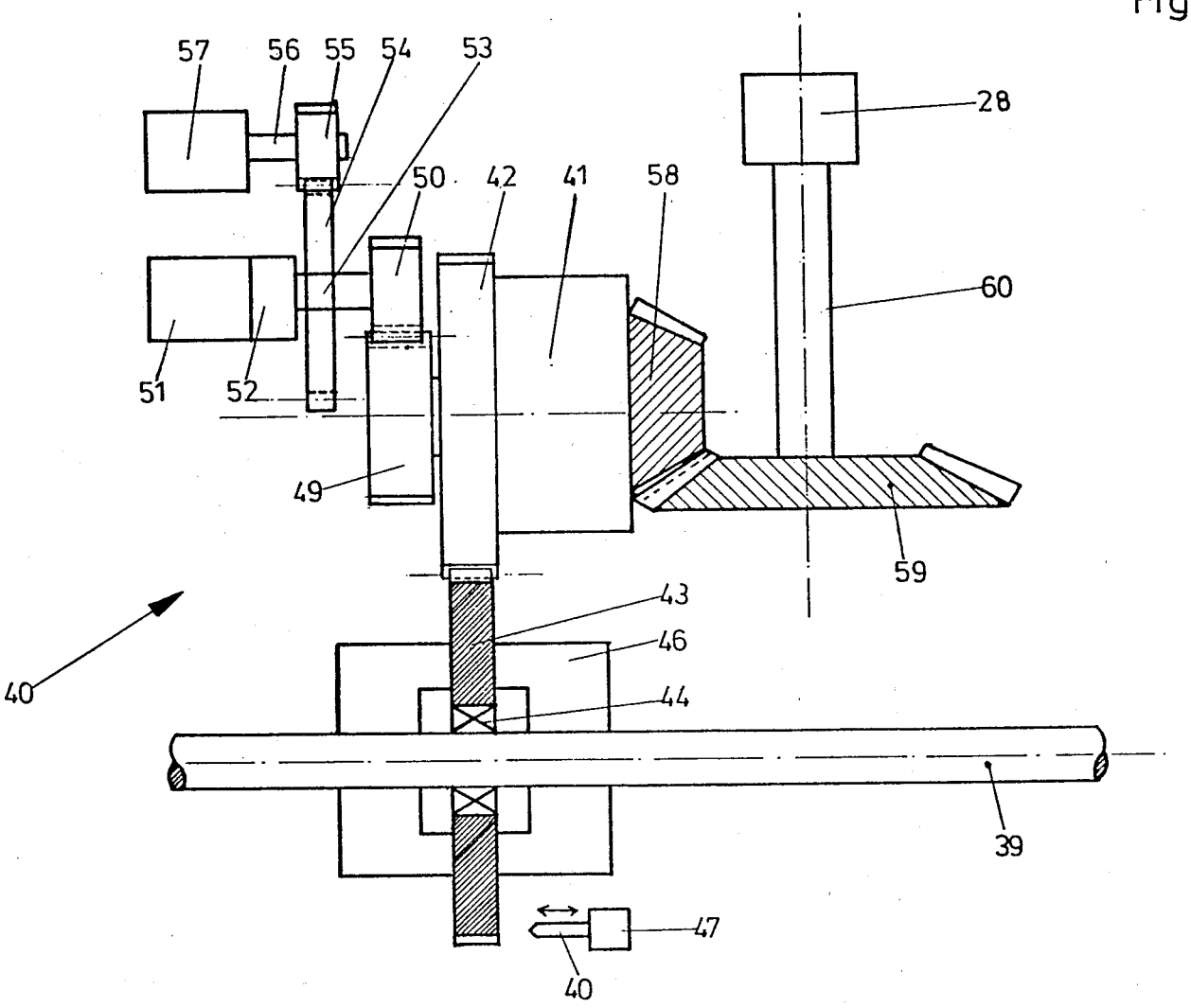
FIG. 6 is a schematic top view of the transmission of each printing station.

FIG. 6 shows a part of the main drive shaft 39 of the corrugated paper machine. The main drive shaft 39 extends throughout the entire length of the corrugated paper machine. All drives are derived from it in the area for each of the printing stations. Each individual printing station 13 has a transmission 40 as diagrammatically shown in FIG. 6. This transmission 40 consists of the following individual components: The core of the transmission 40 is a planetary gear stage 41. The one input 43, i.e. for example the outer gear of the planetary gear stage, meshes with a gear 43 which is journaled on the main drive shaft 39 via a ball bearing 44. A first coupling (friction coupling 45) and a second mechanical engagement coupling 46 are provided between the gear 43 and the main drive shaft. When the printing station is not in operation, the two couplings 45 and 46 are disengaged.

An arresting device 47 which may be for example electromechanically operable, having a pin that can be pushed between the teeth of the gear 43, can be used to additionally block the gear 43.

This is always effected when a carrier band 30 at this printing station 13 is to be exchanged. The second input 49 of the planetary gear stage 41 is connected via a gear 50 with a setting device 51 for fine adjustment. Between the setting device 51 and the gear 50 a coupling 52 is provided. An additional gear 54 is mounted on the shaft 53 and cooperates with a further gear 55 on the shaft 56 of a second setting device 57 for coarse adjustment purposes.

The two setting devices 51 and 57 may be constructed as setting motors, for example it is achieved that during a step of approximately 200 milliseconds of the setting device 51 for the fine adjustment a correction at the circumference of the counterpressure cylinder 28 of approximately 0.16 mm is obtained.

At the output 58 of the planetary gear stage 41 there is provided a bevel gear stage 59 with the shaft 60, which leads to the printing cylinder 28. In this manner, a deflection of the drive through 90° is obtained.

This is necessary because the main drive shaft 39 extends in longitudinal direction of the machine, whereas the printing stages are integrated transversely thereto in the corrugated paper installation.

When the gear 43 is arrested by the device 47 one or both of the setting devices 51 and 57 can operate it, whereby the installed carrier band of the corresponding printing station advances slowly. Thus, a certain preadjustment of the mark on this carrier band can be effected in preparation for the relative pattern rapport.

Subsequently thereto, the setting of the relative pattern rapport of the printing stations relative to one another is obtained, which printing stations are associated with a particular printing run. For this, the gear 43 is first released by the device 47 and the friction coupling 45 engaged, so that with still as yet unoperated setting devices 51 and 57 the printing cylinder 28 is started up and accelerated, until it has a circumferential speed corresponding to the drive of the main drive shaft 39.

Once this is achieved, then additionally the coupling 46 is engaged, and the friction coupling 45 may remain in engagement during this period.

The printing cylinder 28 now idles corresponding to the drive of the main drive shaft 39, via the planetary gear stage 41. The speed of the carrier band thus corresponds to the intended production speed, but the relative pattern rapport has not yet been achieved.

The phase position of each mark of each carrier band of the printing stations associated for a particular operating run is now observed via an observation device and a computer as well as a subsequentially arranged indicating instrument, for example a screen. If this phase position does not yet agree, i.e. if the relative pattern rapport has not yet been reached, then actuation of one or both setting devices 51 and 57 briefly supplies a drive to the second input 49 of the planetary gear stage 41, so that the corresponding carrier band is additionally accelerated or delayed, depending upon the direction of rotation effected by the setting device 51. In this manner, the mark of the carrier band of one printing station can be shifted relative to the mark of the carrier band of another printing station, until the relative pattern rapport is achieved, taking into account the distance between the two associated printing stations. When the marks overlap one another, i.e. are in rapport, then the time has come at which these two pr:nting stations can be pressed against the paper web, i.e. at which printing is immediately possible in rapport without printing of scrap and without interrupting of the corrugated paper manufacture.

This switch-over from idling to printing is mostly effected by appropriate displacement of the counterpressure cylinder 29, which is moved against the printing cylinder 28.

I claim:

1. An arrangement for manufacturing printed corrugated paper cuts with a corrugated paper machine, comprising: an integrated rotary printing machine having a plurality of printing stations in said corrugated paper machine; longitudinal cutter means and transverse cutter means; drive means; said printing stations being integrated for printing a paper web with laterally adjacent areas of different width and length which are selectively connectable with said drive means; said printing stations carrying for each area printing forms mounted on an endless exchangeable carrier band of different lengths, said longitudinal cutter means and transverse cutter means being provided for different area lengths; transmission means having a friction coupling and a mechanical engagement coupling for driving integrated printing stations from said drive means of the corrugated paper machine; said transmission means of each printing station having a planetary gear stage with one input connectable via said two couplings with a drive shaft of the corrugated paper machine for setting carrier bands carrying printing forms of printing stations with reference to one another, said planetary gear stage having a second input connectable with at least one setting device, said planetary gear stage having one output leading to a printing cylinder of the printing station.

2. A corrugated paper installation according to claim 1, including two setting devices for coarse setting and fine setting of said carrier bands, and a further coupling between the setting device for fine setting and the second input of said planetary gear stage.

3. An arrangement for manufacturing printed corrugated paper cuts with a corrugated paper machine, comprising: an integrated rotary printing machine having a plurality of printing stations in said corrugated paper machine; longitudinal cutter means and transverse cutter means; drive means; said printing stations being integrated for printing a paper web with laterally adjacent areas of different width and length which are selectively connectable with said drive means; said printing stations carrying for each area printing forms mounted on an endless exchangeable carrier band of different lengths, said longitudinal cutter means and transverse cutter means being provided for different area lengths; counter printing cylinders associated with the individual printing stations and constructed to extend over full width of the paper web; said carrier band with printing cylinders and the support and tension rollers extending only over a part of a width of the paper web; said carrier bands with the printing cylinders and support and rollers being arranged so as to be movable transverse to the direction of advancement of the paper web and adjustable according to a position of the paper area; said printing stations being provided approximately in accordance with double, triple or a multiple of a number of paper areas; transmission means having a friction coupling and a mechanical engagement coupling for driving integrated printing stations from said drive means of the corrugated paper machine; said transmission means of each printing station having a planetary gear stage with one input connectable via said two couplings with a drive shaft of the corrugated paper machine for setting carrier bands carrying printing forms of printing stations with reference to one another, said planetary gear stage having a second input connectable with at least one setting device, said planetary gear stage having one output leading to a printing cylinder of the printing station; two setting devices for coarse setting and fine setting of said carrier bands, and a further coupling between the setting device for fine setting and the second input of said planetary gear stage.

* * * * *